United States Patent [19]

Thiere et al.

[11] 4,295,142

[45] Oct. 13, 1981

[54] CORRUGATED HORN RADIATOR

[75] Inventors: Helmuth Thiere, Munich; Werner Vallentin, Groebenzell, both of Fed. Rep. of Germany

[73] Assignee: Siemens Aktiengesellschaft, Berlin & Munich, Fed. Rep. of Germany

[21] Appl. No.: 171,143

[22] Filed: Jul. 22, 1980

[30] Foreign Application Priority Data

Jul. 30, 1979 [DE] Fed. Rep. of Germany ..... 2930932

[51] Int. Cl.[3] ..... H01Q 19/12; H01Q 13/02

[52] U.S. Cl. ..... 343/781 CA; 343/786

[58] Field of Search ..... 343/786, 781 CA, 840, 343/781 R, 781 P

[56] References Cited

U.S. PATENT DOCUMENTS 3,896,449 7/1975 Blume ..... 343/786
4,106,026 8/1978 Bui-Hai ..... 343/786

FOREIGN PATENT DOCUMENTS 2449106 4/1976 Fed. Rep. of Germany .
2836869 2/1980 Fed. Rep. of Germany .

OTHER PUBLICATIONS

IEEE Transactions on Antennas and Propagation, vol. AP-26, No. 5, Sep. 1978, pp. 654–658, entitled "Shielding Effectivenuess of Corrugations in Corrugated Horns."

IEEE Transactions on Antennas and Propagation, vol. AP-26, No. 2, Mar. 1978, entitled "Design of Corrugated Conical Horns", pp. 367–371.

IEEE Transactions on Antennas and Propagation, vol. AP-24, No. 6, Nov. 1976, entitled "Broadbanding of Corrugated Conical Horns by Means of the Ring-Loaded Corrugated Waveguide Structure," pp. 786–792.

Electronics Letters Mar. 20, 1975, pp. 131–133.

Electronic Letters Aug. 7, 1975, vol. 11, No. 16, entitled "Dual-Frequency-Band Feed With Partially-Dielectric-Loaded Grooves".

Proceedings IEE vol. 118, No. 9, Sep. 1971, entitled "Propagation and Radiation Behaviour of Corrugated Feeds," pp. 1167–1176.

Proceedings of IEEE vol. 118, No. 9, Sep. 1971, entitled "Propagation and Radiation Behaviour of Corrugated Feeds-Pt. 2."

*Primary Examiner*—Eli Lieberman

*Attorney, Agent, or Firm*—Hill, Van Santen, Steadman, Chiara & Simpson

[57] ABSTRACT

A corrugated horn radiator which includes a transition zone made up of a number of parts between the smooth-wall feed wave guide 1 having a cross-section which is constant and a horn radiator with regular periodic corrugations 10 with the depth of the corrugations being less than one-quarter wave length relative to the lowest frequency to be transmitted. The transition zone starting at the constant diameter feed wave guide comprises a first section which is conical shaped and then joins a second section which is cylindrical in shape and which serves as a phase drift space and then connects to a second conical smoothed walled portion and then connects to an exponential horn having a pair of corrugations with re-entrant ring-shaped ends (6, 7) which are narrower than the regular periodic corrugation structure 10. The pair of corrugations 6 and 7 connect with a corrugated transition section 8 which comprises a plurality of corrugations which have depths that become progressively less as they approach the regular corrugations 10 and wherein the apex angle of the transition portion 8 is greater than the apex angle of the regular corrugation portion 10. The corrugated horn radiator of the invention has good broad band characteristic and favorable broad band cross-polarization characteristics and the corrugated horn radiator can be employed as a horn antenna or as a feed horn for a Cassegrain or focus fed antenna.

7 Claims, 3 Drawing Figures

CORRUGATED HORN RADIATOR

BACKGROUND OF THE INVENTION

1. Field of the Invention

This invention relates in general to a corrugated horn radiator which has a transition zone mounted between a smooth-walled feed wave guide having a constant cross-section and a funnel radiator having regular periodic corrugation structures which have depths of corrugations less than a quarter-wave length with respect to the lowest operating frequency to be transmitted.

2. Description of the Prior Art

For the operation of transmission/reception antennas having emission and two orthogonal polarizations, it is necessary to employ radiators preferably having low cross-polarization. A rotational-symmetrical radiation field and a low reflection factor are presumed. Corrugated horn radiators are used in a wide range of applications in microwave antennas because of these favorable electrical properties. Corrugated horn radiators previously have maximum band width of approximately 20% and do not have broad band characteristics and have not had good cross-polarization characteristics. Several prior art corrugated horn radiators function with a depth of corrugation that is greater than one-quarter wave length. Also, corrugated horn radiators are known in which the corrugations for the lower frequency band are less than a quarter wave length in depth as described in the publication IEEE Transactions, Vol. AP-26, No. 2, March 1978, pages 367 through 372. Such described corrugated horn radiators have a relatively good radiation diagram symmetry in the lower frequency range and a low reflection factor in the upper frequency range. However, they do not provide sufficient matching in the lower frequency range and have diagram asymmetry and a higher cross-polarization in the upper frequency range.

SUMMARY OF THE INVENTION

It is an object of the present invention to provide a transition zone for a corrugated horn radiator which is designed so that is has favorable broad band with respect to matching as well as with respect to the diagram symmetry and the cross-polarization so that a horn radiator and reflector antenna can be utilized which covers a receiving range of 3.7 GHz through 4.2 GHz and has a transmission band from 5.9 to 5 GHz through 6.424 GHz, e.g.

The object of the invention is achieved in that a transition zone is provided which connects to the smooth circular wave guide and has the following sections connected to each other.

1. A uniformly constantly expanding smooth-walled wave guide section.

2. A smooth-walled wave guide section having a fixed cross-sectional diameter and which serves as a phase or drift space.

3. A funnel section smoothly connected to section 2 and which continuously increases in diameter particularly exponentially.

4. A funnel section connected to section 3 smoothly and without bends and which continuously increases in diameter particularly exponentially in cross-section and which has a first matching zone consisting of at least two corrugations which have widths that are significantly narrower than the corrugations of the periodic corrugated structure and which are suitably matched in their width and which also have depths which are deeper than the corrugations in the periodic corrugation structure and which are provided with ring expansions which extend toward the feed wave guide and which are approximately one-eighth of a wave length in depth relative to the lowest operating frequency to be transmitted.

5. A funnel section which increases uniformly in cross-section diameter which has a second matching zone which consists of a plurality of adjacent corrugations which have depths that become progressively less until they match the depth of the regular corrugation structure at the joining point between this funnel section and the regular corrugated section.

Advantageously, the apex angle of the funnel section of the second matching zone is greater than the apex angle of the funnel radiator which is attached thereto that has the regular periodic corrugation structure.

A corrugated horn radiator has previously been proposed and described in the West German Patent Application No. P 28 36 869.6 wherein an adaptation zone is mounted between a smooth-walled feed wave guide section and a periodic conically expanding wave guide with the adaptation zone being formed by a single corrugation which is dimensioned so as to be significantly narrower than the corrugations of the periodic corrugation structure and which has a depth of approximately a quarter wave length and is provided with a ring shape expansion in the direction toward the feed wave guide.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
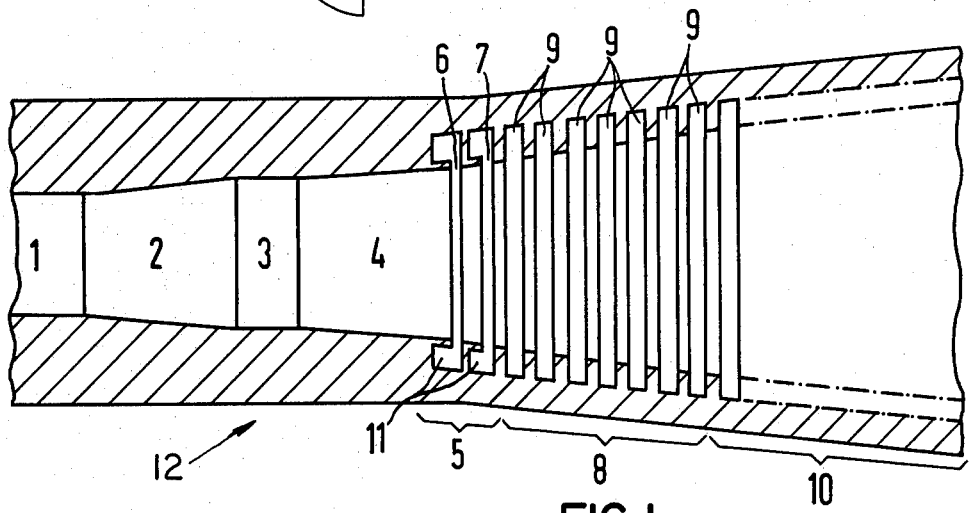
FIG. 1 comprises a sectional view through the corrugated wave guide of the invention.

The sample embodiment of the corrugated horn radiator according to the invention has a round cross-section and is explained relative to FIG. 1.

FIG. 1 shows a longitudinal sectional view of a corrugated horn radiator. The radiator has rotational symmetry and, thus, a circular cross-section and is designed for use for example for a receiving band of 3.7 GHz through 4.2 GHz and for a transmitting band of 5.925 GHz through 6.425 GHz. The constant diameter smooth-walled feed wave guide 1 connects to a conically expanding smooth-walled wave guide section 2 which has an apex conical angle of approximately 1 degree. Attached to the conical wave guide section 2 is a cylindrical smooth-walled wave guide section 3 which serves as a shift drift space and has a specified length as well as a specified diameter to correct for the desired wave drift. Cylindrical section 3 joins a smooth-walled section 4 of an exponential horn and makes a smooth transition without breaks and bends to the smooth-walled section 4. The smooth-walled portion 4 connects to a first matching zone 5 which has two adjacent corrugations 6 and 7 which can be filled with dielectric material. A conical horn section with a second matching zone 8 connects to the zone 5. The second matching zone 8 comprises a plurality of successive corrugations 9 which continuously decrease in depth from the left of FIG. 1 to the right of FIG. 1. Connected to the second matching zone 8 is the conically expanding regular periodic corrugation structure 10 which has a plurality of corrugations which have depths of less than one quarter wave length relative to the lowest operating frequency to be transmitted.

The two successive corrugations 6 and 7 in the first matching zone 5 are significantly narrower in width than the corrugations of the regular periodic corrugation structure 10 and are suitably matched in width. The depth of the corrugations 6 and 7 is greater than the corrugations in the periodic corrugation structure 10. Also, the corrugations 6 and 7 have ring shaped openings 11 which point in the direction toward the feed wave guide 1 as shown in the Figure.

It is to be noted that the apex angle of the horn section 8 is greater than the apex angle of the funnel radiator with the regular periodic corrugation structure 10 to which it attaches.

In a conventional corrugated horn radiator, the transition from the feed wave guide to the horn radiator area which is the beginning of the corrugated structure, the horn radiator aperture comprises a discontinuity and disrupts the stable field of a propagating electromagnetic wave. In the sample embodiment of the invention illustrated in the Figure, the sharply localized break between the feed wave guide and the horn radiator is coupled by the smooth-walled wave guide sections which conically expand and gradually open to the taper of the transition. This feature provides that specific interactions such as dummy energy and standing waves are greatly reduced in the transition region between the feed wave guide and the first horn radiator corrugation structure which attaches thereto.

Also, the form of the corrugated structure and the initial diameter are selected in the invention such that only a slight constriction of the effective cross-section of the propagating wave exists. The invention also provides improved results because the matching zone 8 has a greater apex angle than the regular periodic corrugation structure 10.

The necessary wall impedance for generating a stable symmetrical hybrid field distribution can be finely adjusted by matching the slot widths of the corrugations 6 and 7 in the transition portion. By doing this, very low reflections will result over the entire band width.

The required $TM_{11}$ excitation in the transmission band for the stabilization of good symmetrical properties over the entire band width is achieved by means of fine adjustment of the length of the phase drift transition portion 3. The cross-section of the phase drift portion 3 is selected such that the excitation becomes effective only at the higher frequencies.

Due to the special design in the region between the smooth-walled feed wave guide 1, the conically expanding smooth-walled guide section 2 and the cylindrical smooth-walled guide section 3 a desired improvement of the diagram symmetry occurs in the transmission band utilized. This occurs due to the excitation of a higher type wave ($TM_{11}$ wave) in wave guide section 2 and due to the favorable adjustment of the phase relation with respect to the fundamental wave ($TE_{11}$ wave) due to the wave guide section 3 for the formation of the $TEM_{11}$ wave in the corrugated horn radiator which is connected to it and by forming the phase drift space. For a further explanation, see the article by Claricoats "Propagation and Radiation Behaviour of Corrugated Feeds" from the "Proceedings of the IEEE", Vol. 118, No. 9 of September 1971, Parts 1 and 2.

Figure 2:
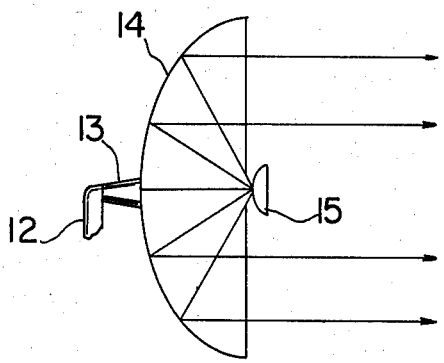
FIG. 2 illustrates a Cassegrain antenna utilizing the invention.

FIG. 2 illustrates the invention 12 as applied to a Cassegrain antenna which has a feed 13, a main reflection 14 and a feed reflector 15.

Figure 3:
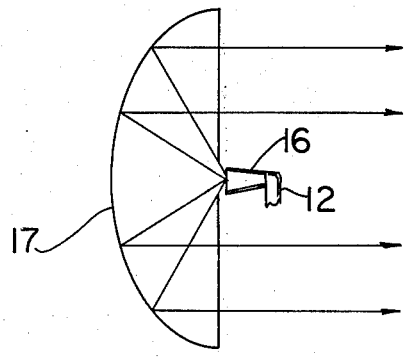
FIG. 3 illustrates a focus-fed antenna utilizing the invention.

FIG. 3 illustrates a focus-fed antenna in which the invention is incorporated and illustrates the invention 12 coupled to a radiator 16 which is mounted at the focus of a parabolic reflector 17.

Although the invention has been described with respect to preferred embodiments, it is not to be so limited as changes and modifications can be made therein which are within the full intended scope as defined by the appended claims.

We claim as our invention:

1. A corrugated horn radiator in which a transition zone is inserted between a smooth-walled wave guide feed with a constant cross-section and a funnel radiator with a regularly periodic corrugation structure with a corrugation depth of less than a quarter wave length with reference to the lowest operating frequency, characterized in that, proceeding from the said wave guide feed (1), the transition zone consists of the following sections attached to one another in the following order:

(a) a uniformly expanding, smooth-walled wave guide section (2), (b) a smooth-walled wave guide section (3) designed with a constant cross-section connected to wave guide section (2), (c) a smooth-walled funnel section (4) connected to wave guide section (3) smoothly and bend-free and which continuously increases in diameter particularly exponentially, with respect to its cross-section dimension, (d) a funnel section connected to wave guide section (4) smoothly and bend-free, continuously increasing in diameter, particularly exponentially, with respect to its cross-section dimension, said funnel section having a first matching adaptation zone (5) which consists of at least two successive corrugations (6, 7) which are dimensioned considerably narrower with respect to their widths than are the corrugations of the periodic corrugation structure (10) and are also suitably matched in width, which exceed in depth the corrugation depths in the periodic corrugation structure (10) and which are provided with ring-shaped openings (11) which extend in the direction toward the wave guide feed (1), said openings (11) being approximately one eighth a wave length deep with respect to the lowest operating frequency to be transmitted, and (e) a uniformly increasing funnel section with respect to its cross-section dimension which has a second matching adaptation zone (8) which consists of a plurality of successive corrugations (9) with depths continuously graduated up to the depths of the regular corrugation structure (10).

2. A corrugated horn radiator according to claim 1, characterized in that the apex angle of the funnel section with the second matching adaptation zone (8) is greater than the apex angle of the horn radiator with the regularly periodic corrugation structure (10).

3. A corrugated horn radiator according to claim 2, characterized in that the corrugations (6, 7) in the funnel section with the first matching adaptation zone (5) are filled with dielectric material.

4. A corrugated horn radiator according to claim 1 characterized in that the radiators is a primary radiator used in a Cassegrain antenna.

5. A corrugated horn radiator according to claim 1 characterized in that the radiator is the primary radiator in a focus-fed antenna.

6. A corrugated horn radiator according to claim 1 characterized in that the radiator is used as a horn antenna.

7. A corrugated horn radiator according to claim 1 characterized in that the cross-section of the horn radiator has rotational symmetry.

* * * * *